US009198526B2

(12) United States Patent
Meyer et al.

(10) Patent No.: US 9,198,526 B2
(45) Date of Patent: Dec. 1, 2015

(54) ADJUSTABLE DISPENSER FOR CUPS AND OTHER CUP-SHAPED ARTICLES

(71) Applicants: Michael H. Meyer, Sagamore Hills, OH (US); Michael A. Kolar, North Royalton, OH (US)

(72) Inventors: Michael H. Meyer, Sagamore Hills, OH (US); Michael A. Kolar, North Royalton, OH (US)

(73) Assignee: The Meyer Company, Cleveland, OH (US)

( * ) Notice: Subject to any disclaimer, the term of this patent is extended or adjusted under 35 U.S.C. 154(b) by 0 days.

(21) Appl. No.: 14/320,452

(22) Filed: Jun. 30, 2014

(65) Prior Publication Data

US 2014/0312057 A1 Oct. 23, 2014

Related U.S. Application Data

(63) Continuation of application No. 13/110,375, filed on May 18, 2011, now Pat. No. 8,763,854.

(60) Provisional application No. 61/346,154, filed on May 19, 2010.

(51) Int. Cl.
*A47F 1/08* (2006.01)
*A47F 1/06* (2006.01)

(52) U.S. Cl.
CPC ..... *A47F 1/085* (2013.01); *A47F 1/065* (2013.01)

(58) Field of Classification Search
CPC ..... A47F 1/085
USPC ..... 221/33, 44, 59, 208, 241, 279, 303, 221/307, 310
See application file for complete search history.

(56) References Cited

U.S. PATENT DOCUMENTS

| | | | | |
|---|---|---|---|---|
| 827,480 | A | 7/1906 | Traut | |
| 897,480 | A * | 9/1908 | Traut | 450/142 |
| 1,207,092 | A | 12/1916 | Sullivan | |
| 2,730,268 | A | 1/1956 | Moesch | |
| 3,071,292 | A | 1/1963 | Atwood et al. | |
| 3,163,323 | A * | 12/1964 | Behrens et al. | 221/4 |
| 3,265,243 | A | 8/1966 | Velter | |
| 3,623,636 | A | 11/1971 | D'Ercoli et al. | |
| 3,844,444 | A | 10/1974 | Carroll | |
| 4,126,248 | A | 11/1978 | House | |
| 4,234,101 | A | 11/1980 | Pastore | |

(Continued)

OTHER PUBLICATIONS

International Search Report mailed Oct. 3, 2011 for International application No. PCT/US2011/36974.

(Continued)

*Primary Examiner* — Patrick Mackey
(74) *Attorney, Agent, or Firm* — Fay Sharpe LLP

(57) ABSTRACT

A cup dispenser includes a body defining a storage region adapted for receiving for an associated stack of cup-shaped articles. The body includes an open end that provides access to the storage region. Multiple fingers are connected to the body for restricting the open end of the body. An adjustment ring is connected to the body and is movable relative to the body. Movement of the adjustment ring relative to the body alters a position of each of the fingers relative to the body. The adjustment ring includes a plurality of adjustment slots and the fingers each include an adjustment stud located in one of the adjustment slots. When the adjustment ring is rotated, the adjustment slots act as cams and the adjustment studs act as cam followers such that the fingers are simultaneously and uniformly adjusted in terms of their radial position relative to the body wall.

17 Claims, 11 Drawing Sheets

(56) References Cited

U.S. PATENT DOCUMENTS

| | | | | |
|---|---|---|---|---|
| 4,426,017 | A | 1/1984 | Ficken et al. | |
| 4,580,697 | A | 4/1986 | Maulshagen et al. | |
| 4,658,983 | A | 4/1987 | Suttles | |
| 4,804,108 | A | 2/1989 | Ficken | |
| 4,840,291 | A | 6/1989 | Merlin | |
| 4,854,479 | A * | 8/1989 | Callahan et al. | 221/304 |
| 4,881,660 | A | 11/1989 | Suttles | |
| 4,925,058 | A | 5/1990 | Ozawa | |
| 5,012,952 | A | 5/1991 | Franz | |
| 5,014,878 | A | 5/1991 | Janz | |
| 5,135,136 | A * | 8/1992 | Moone | 221/304 |
| 5,199,601 | A | 4/1993 | Roethel | |
| 5,201,869 | A | 4/1993 | Roethel | |
| 5,222,628 | A | 6/1993 | Roethel | |
| 5,518,149 | A | 5/1996 | Lotspeich et al. | |
| 5,709,316 | A | 1/1998 | Jolly et al. | |
| 5,941,415 | A | 8/1999 | Roethel | |
| 6,117,391 | A | 9/2000 | Mootz et al. | |
| 6,199,723 | B1 | 3/2001 | Collins et al. | |
| 6,772,908 | B2 | 8/2004 | Roethel et al. | |
| 6,789,697 | B2 | 9/2004 | Neess | |
| 6,966,454 | B2 | 11/2005 | Kawolics et al. | |
| 7,055,234 | B2 | 6/2006 | Roethel et al. | |
| 7,325,701 | B1 | 2/2008 | Meyer et al. | |
| 8,763,854 | B2 * | 7/2014 | Meyer et al. | 221/310 |
| 2007/0295746 | A1 | 12/2007 | Gapp | |
| 2009/0057334 | A1 | 3/2009 | Pearl et al. | |
| 2011/0226799 | A1 | 9/2011 | Watson et al. | |

OTHER PUBLICATIONS

Written Opinion of the International Searching Authority mailed Oct. 3, 2011 for International application No. PCT/US2011/36974.

Photograph of San Jamar "Sentry"—Adjustable Cap Dispenser, publication date unknown.

San Jamar Sentry One-Size-Fits-All, Dispenser Brochure / Instructions, product date unknown.

Velter In-Counter Dispensers / Versa Cup, product date unknown.

Dispense Rite In-Counter Adjustable Cup Dispensers, product date unknown.

Dispense Rite Catalog pp. 1-67 (see pp. 1-39), product date unknown.

* cited by examiner

ADJUSTABLE DISPENSER FOR CUPS AND OTHER CUP-SHAPED ARTICLES

CROSS-REFERENCE TO RELATED APPLICATIONS

This application is a continuation of U.S. application Ser. No. 13/110,375 filed May 18, 2011 (May 18, 2011), now assigned U.S. Pat. No. 8,763,854, which claims priority from and benefit of the filing date of U.S. provisional application Ser. No. 61/346,154 filed May 19, 2010 (May 19, 2010), and the entire disclosure of each of said prior applications is hereby incorporated by reference into the present specification.

BACKGROUND

The present development is directed toward the art of dispensers for cups and other cup-shaped articles (e.g., french fry containers, soufflé cups, ice-cream cones, etc.) and, more particularly, to a new and unobvious cup dispenser assembly. The term "cup" as used herein is intended to encompass cups and any other cup-shaped article suitable for being dispensed one-at-a-time from an interfitted or nested stack. Dispensers of the type under consideration herein are commonly employed in restaurants and convenience stores to maintain a supply of paper, plastic, foam, and/or other disposable cups and/or cup-shaped articles near beverage or soft-serve frozen food dispensing equipment for use as required, and cups are dispensed one at a time from the dispenser with the closed ends of the cups in the nested stack of cups oriented outwardly toward the user.

SUMMARY

In accordance with the present development, a cup dispenser comprises a body defining a storage region adapted for receiving for an associated stack of cup-shaped articles. The body includes an open end that provides access to the storage region. A plurality of fingers are connected to the body for restricting the open end of the body. An adjustment ring is connected to the body and is movable relative to the body. Movement of the adjustment ring relative to the body alters a position of each of the fingers relative to the body.

DETAILED DESCRIPTION

Figure 1:
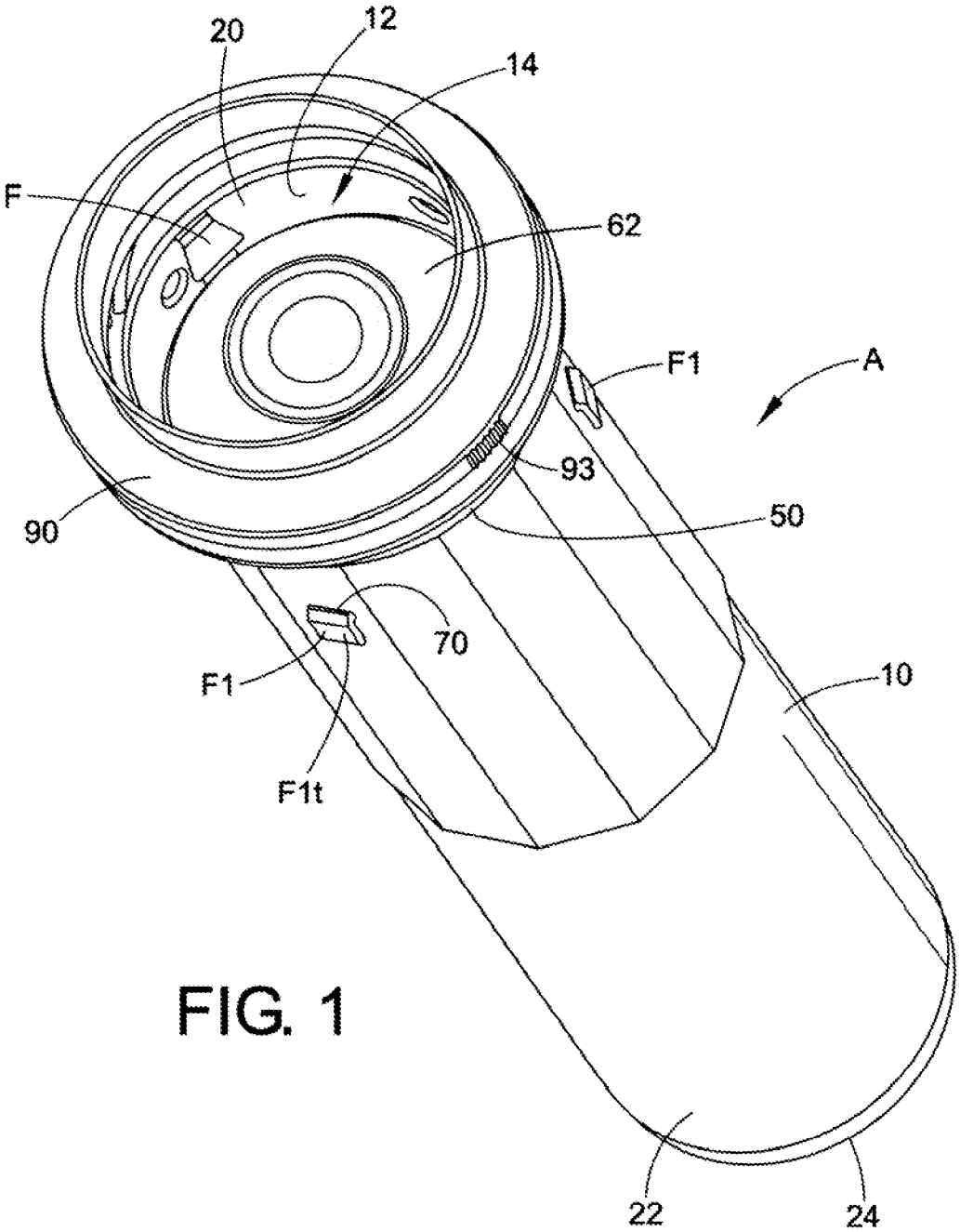
FIGS. 1 and 2 are isometric views of an adjustable cup dispenser formed in accordance with the present development.
Figure 2:
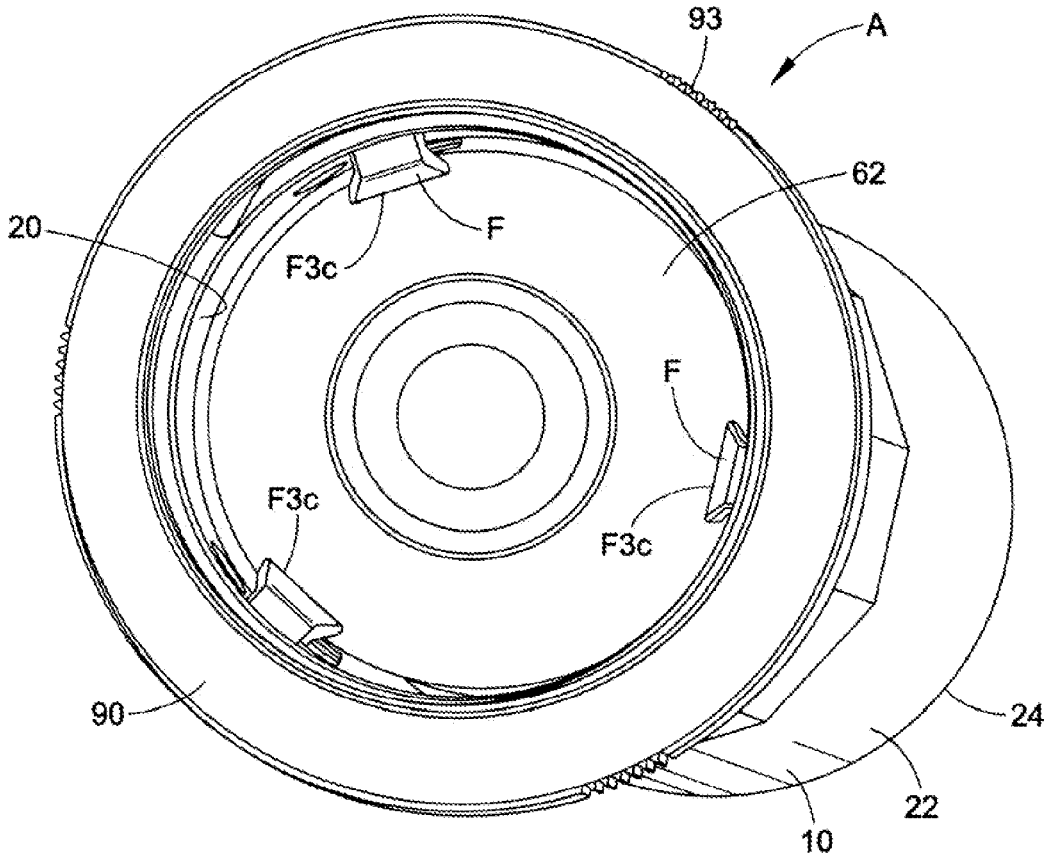
Figure 3:
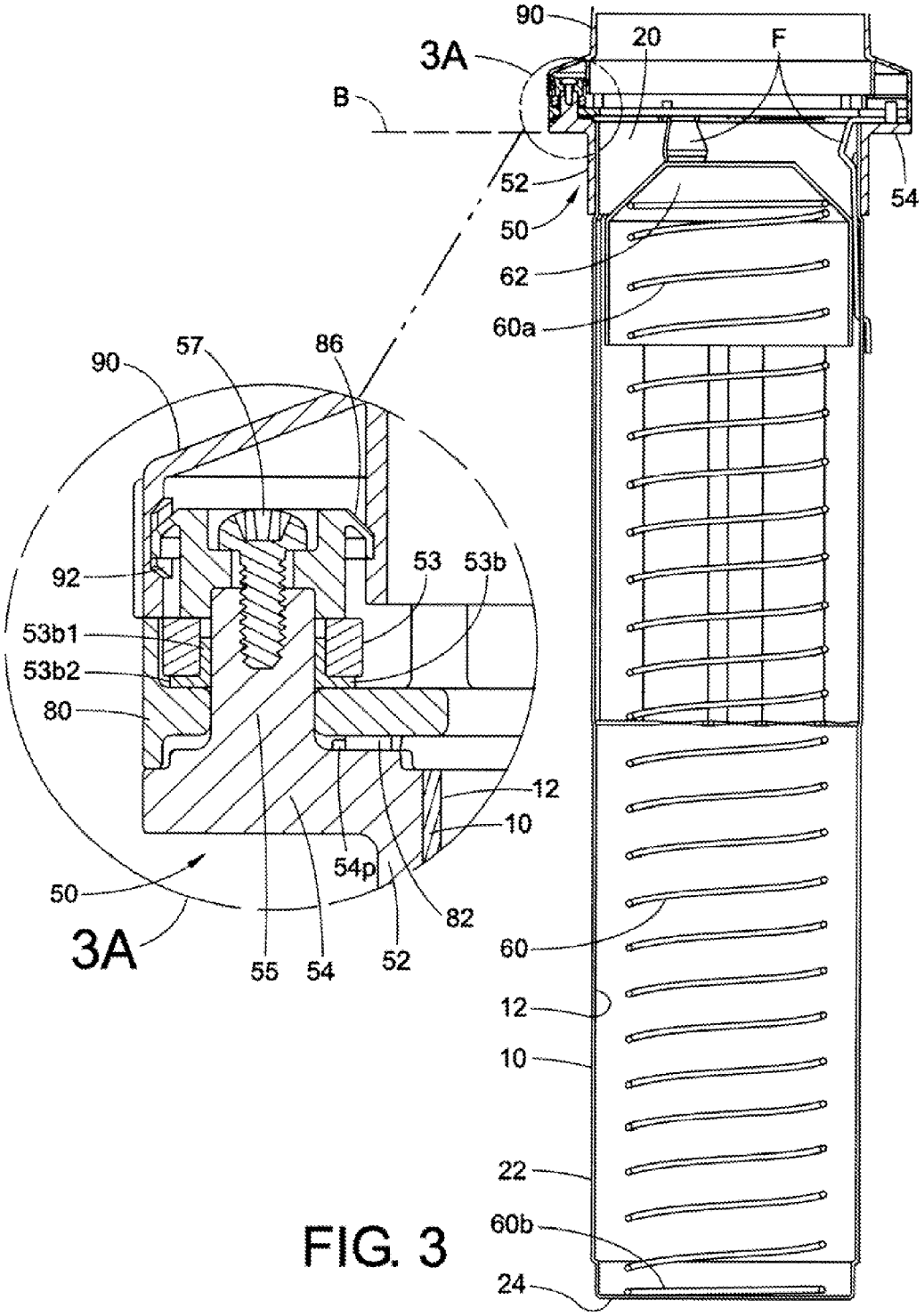
FIG. 3 is a section view of the dispenser including a greatly enlarged detail view of a portion of the dispenser.

An adjustable cup dispenser A constructed in accordance with the present invention is adapted for dispensing cups and other cup-shaped articles. As used herein, the term "cup dispenser" is intended to mean a dispenser for cups or other cup-shaped articles. In use, the cup dispenser A is mounted in a cabinet or other mounting structure B (FIG. 3) and is adapted to maintain a supply of cups or other cup-shaped articles in a readily available condition. The mounting structure B defines an opening into which the cup dispenser is A is inserted and, as is described in full detail below, the dispenser A is fixedly secured to the mounting structure B in an operative position.

The dispenser A comprises an elongated cup storage tube or body 10 including an inner surface 12 that defines a hollow cup storage space/region 14 adapted to receive a telescopically interfitted or nested stack of cups to be dispensed one-at-a-time. The body 10 is illustrated in the preferred, substantially cylindrical and/or polygonal cross-section conformation, but those of ordinary skill in the art will recognize that the body 10 can be defined in any of a wide variety of other configurations so that it defines an elongated hollow cup storage region 14 adapted to receive and confine a nested stack of cups.

The body 10 and cup storage region 14 are defined about a central longitudinal axis L, and the body comprises an open first end 20 that opens into the cup storage region 14 and a closed or restricted or partially closed second end 22. The second end 22 is typically closed or at least restricted by an integral transverse end wall 24. The body 10 can be defined from metal or plastic or any other suitable material as desired.

Figure 4:
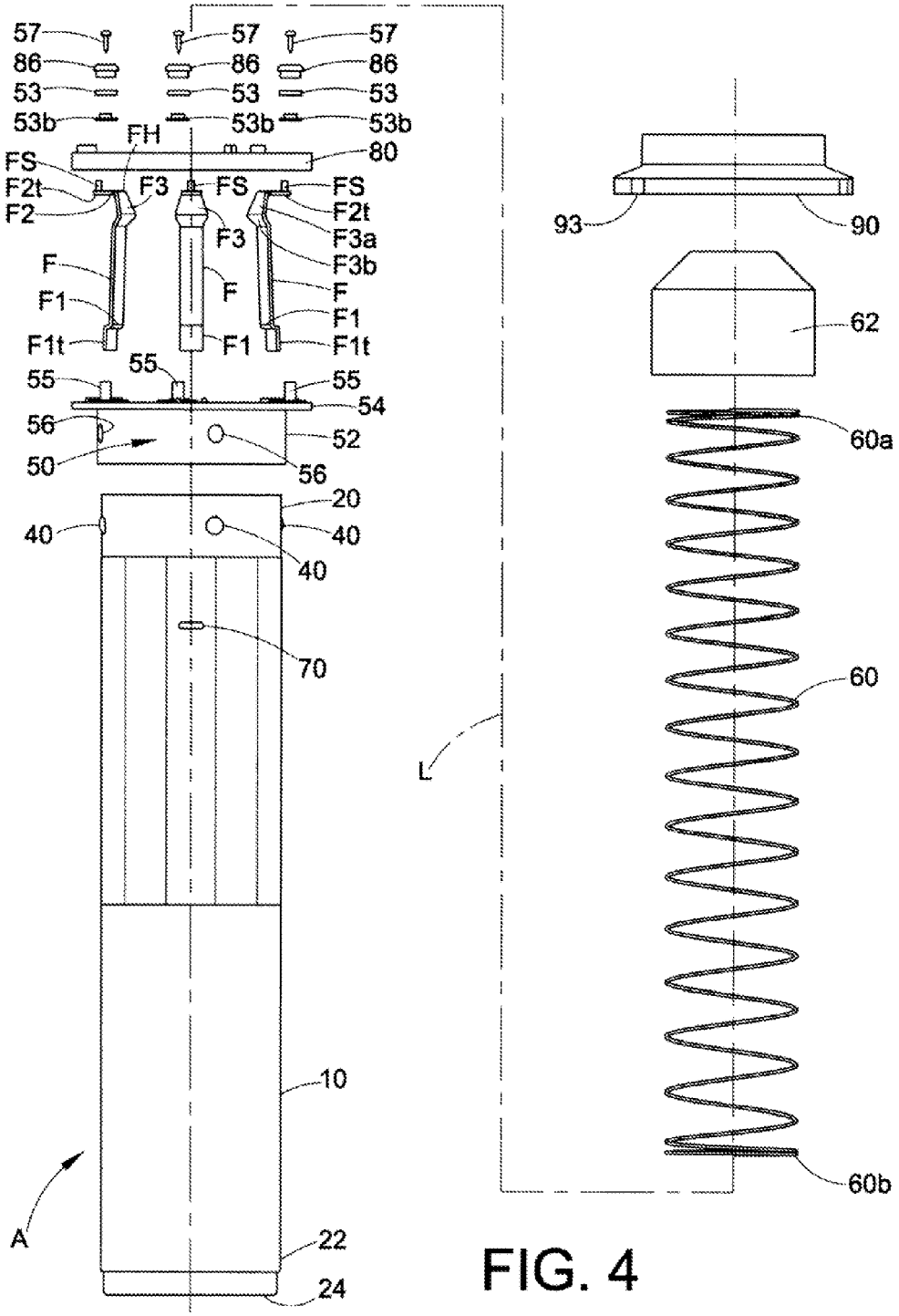
FIG. 4 is an exploded view of the dispenser.

In the illustrated embodiment, the body 10 includes a plurality of lugs or bosses 40 (FIG. 4) defined therein near the open first end 20 (closer to the open end 20 than the closed end 22). If the body is plastic, the bosses 40 are defined during the molding operation and project outwardly from the outer surface of the body. The illustrated body includes four bosses 40 defined symmetrically about the body, but those of ordinary skill in the art will recognize that any number of bosses can be defined, and that these can be arranged in any desired relationship relative to each other.

Figure 8:
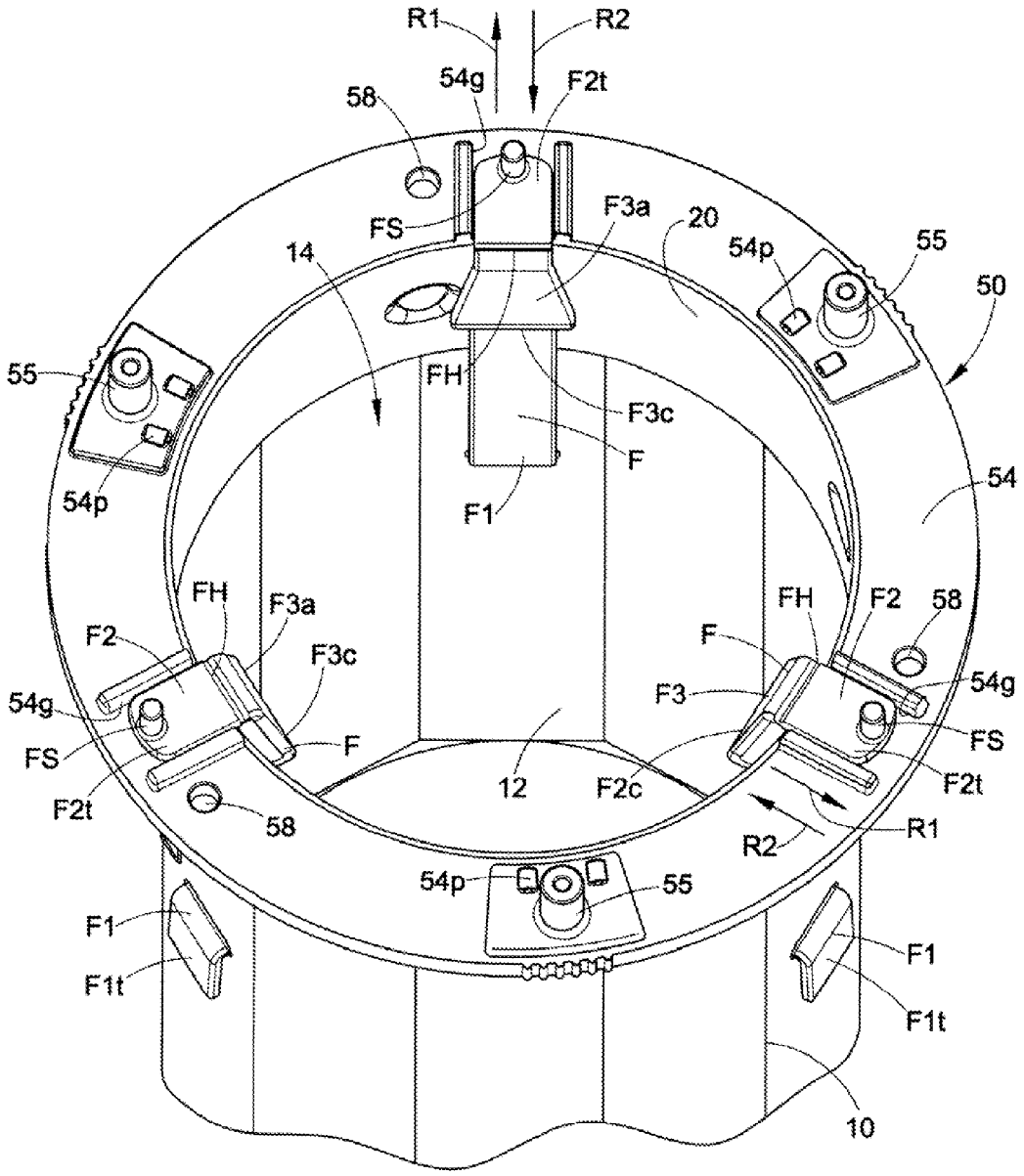
FIG. 8 is similar to FIG. 6 but also omits the adjustment ring to reveal additional structures.

The cup dispenser assembly A further comprises an annular mounting collar 50 defined by a cylindrical portion 52 and a transverse flange 54 that projects radially outward from the cylindrical portion 52. The cylindrical portion 52 includes or defines a plurality of apertures or other recesses 56 (FIG. 4) that open at least inwardly toward the center of the cylindrical portion 52. These recesses 56 are dimensioned and arranged and otherwise adapted for respective receipt of and engagement with the bosses 40 when the collar 50 is coaxially fitted to upper end 20 of the body 10. Alternatively, the collar 50 is secured to a cup storage body 10 via screws, rivets, or other fasteners, or by adhesive or welding, e.g., when the body 10 is defined from stainless steel. The collar 50 can also be defined as part of a one-piece construction including both the body 10 and the collar 50. The collar flange 54 defines a plurality of mounting apertures 58 (FIG. 8). When the cup dispenser A is to be installed into a mounting structure B, the flange 54 is fixedly secured to the mounting structure B, preferably by use of fasteners that pass through mounting apertures 58. An adjustment ring 80 that covers the flange 54 (described in detail below) is rotated to a select position where access openings 88 in the adjustment ring 80 become respectively registered with the mounting apertures 58 to allow installation of the fasteners through the access openings 88. The collar can be defined from a metal or polymeric resin material.

The cup dispenser assembly A preferably comprises a spring or other means for biasing the stack of cups contained in the storage region 14 of the body 10 toward the open end 20 of the body 10 for being dispensed. In the illustrated embodiment, a coil spring 60 (FIG. 3) is disposed in the hollow cup storage region 14 coaxial with the central axis L, and a cup pusher or pushing member 62 is closely and slidably positioned within the hollow cup storage region 14 of the body 10. A first end 60*a* of the coil spring 60 is seated against the cup pushing member 62, and a second end 60*b* of the coil spring 60 is seated against the transverse end wall 24 of the body 10. The pusher 62 moves along the axis L toward and away from the second end 22 of the body, and it is captured in the cup storage space 14 so that it cannot escape through the open end 20 (or closed end 22) of the body 10. In one embodiment, the dispenser A is secured or is adapted to be secured to a mounting structure B in an arrangement where the open first end 20 of the body 10 is placed at a lower elevation than the closed second end 22. In this arrangement, the spring 60 (and pusher 62) can be omitted and the cups are fed through the open first end 20 of the body 10 by gravity.

The cup dispenser A includes a plurality of fingers F connected to the body 10 and located adjacent the open first end 20 of the body to retain cups in the cup storage region 14 and control the dispensing of the cups one at a time. As shown herein, the fingers F also capture the pusher 62 in the cup storage space 14. A portion of each finger F extends inward from the body inner surface 12 toward the center of the cup storage region 14 so that the fingers restrict the open end 20 of the body 10. Each finger F includes a first or inner end F1 that is fixedly secured or connected to the body 10 at a location spaced from the open first end 20, a second or outer end F2 that is movably engaged with the flange 54 of the mounting collar 50 or that is otherwise movably located adjacent the open end 20 of the body 10, and a central ramped portion F3 located between the first and second ends F1,F2. The ramped portion F3 comprises a first ramp surface F3*a* that converges toward the center of the cup storage region 14 as it extends away from the open end 20 of the body 10 toward the opposite end 22 of the body, and includes a second ramp surface F3*b*, located between the first ramp surface and the inner end F1, that diverges away from the center of the cup storage region 14 as it extends away from the open end 20 of the body 10 toward the opposite end 22 of the body. The first and second ramp surfaces F3*a*,F3*b* intersect to define and are connected by a tip F3*c* of the ramped portion F3. The tip F3*c* is the most prominent portion of each finger F, in terms of the distance that the finger F projects into the cup storage space 14 from the inner wall surface 12 of the body 10. It is preferred that each finger F be defined as a one-piece construction from a polymeric resin such that the finger is resiliently flexible and the ramp portion F3 is resiliently movable toward and away from the inner surface 12 of the body when the first and second opposite ends F1,F2 of the finger are restrained against any movement relative to the body 10. The fingers F are circumferentially spaced-apart around the longitudinal axis L, preferably in a symmetrical arrangement as shown such that they provide a uniform and symmetrical gripping force on the cups or other cup-like articles being retained in the cup dispenser A.

As shown herein, the first end F1 of each finger F is connected to the body 10 by engagement of the first end F1 through a mating slot 70 defined in the body 10. The first end F1 of each finger includes a first or inner or mounting tab F1*t* that lies adjacent an outer surface of the body 10, and the first tab F1*t* prevents escape of the finger first end F1 from the slot 70 unless the finger is moved to a position where the first tab F1*t* is aligned with the slot 70, which cannot occur during normal use of the dispenser A.

Figure 6:
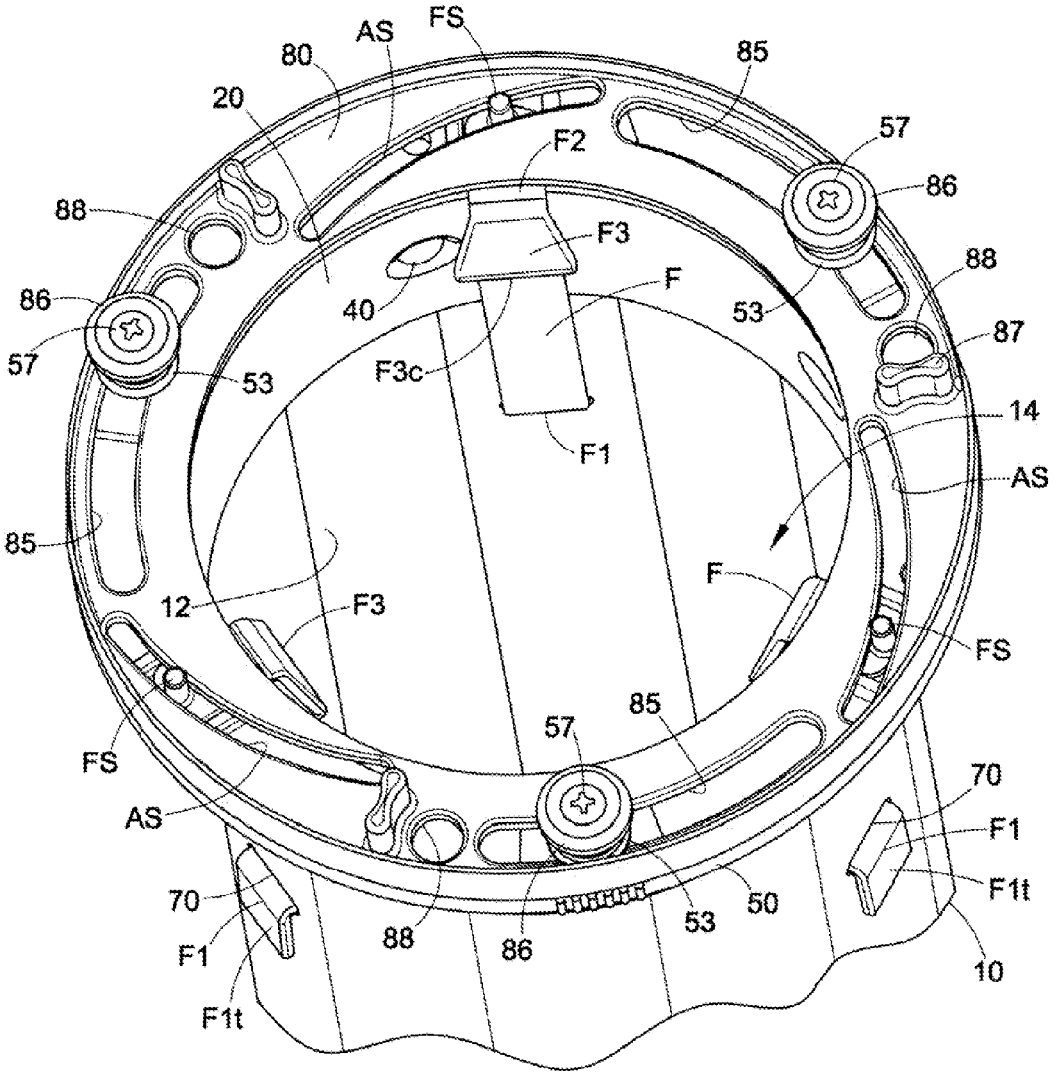
FIG. 6 is an isometric view with the pusher, spring, and decorative cover/clamp ring removed.
Figure 7:
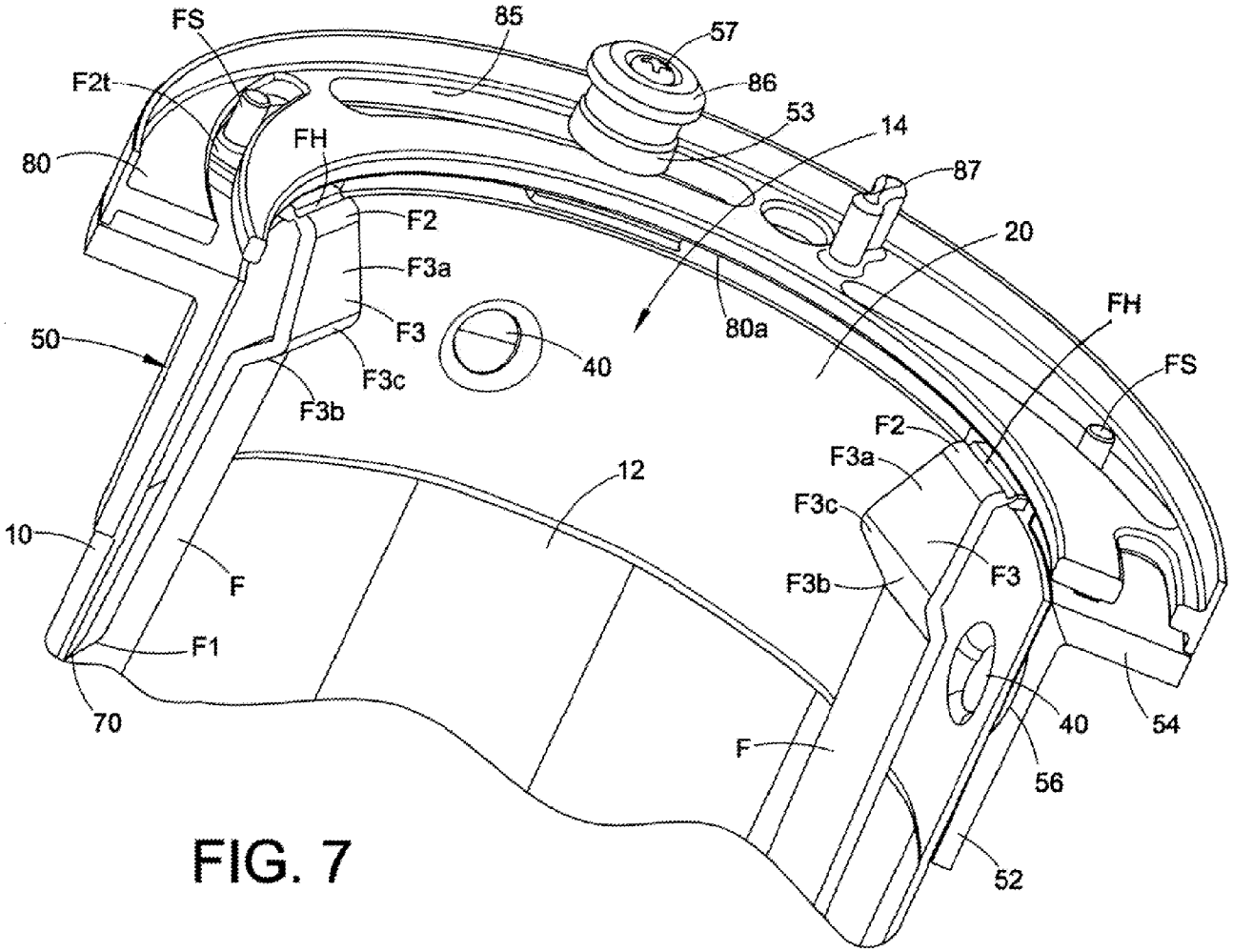
FIG. 7 is similar to FIG. 6 but is sectioned.

Referring particularly now to FIGS. 6-8, the second end F2 of each finger F is captured between an upper face of the flange 54 and an adjustment ring 80 that is movably secured adjacent the flange 54. The second end F2 of each finger F includes a second or outer or adjustment tab F2*t* (FIG. 8) that is arranged to lie adjacent and parallel with the flange 54. The second tab F2*t* is connected to an outer end of the ramp portion F3, in particular to the first ramp surface F3*a*, by a living hinge or like flexible membrane FH that is part of the one-piece construction of each finger F. The upper face of the flange 54 preferably defines a plurality of open slots or open grooves 54*g* that extend radially and that closely and slidably receive respective second tabs F2*t* of the fingers F. The grooves 54*g* are shaped and dimensioned relative to the second tabs F2*t* to allow sliding movement of the second tabs F2*t* only in a radially outward direction R1 or in a radially inward direction R2, without any circumferential or lateral movement transverse to inward and outward radial directions R1,R2. The living hinge FH allows the angle between the second tab F2*t* and the ramp portion F3 of each finger to vary as the second tab F2*t* is moved radially inward or outward during adjustment of the position of the fingers F using the adjustment ring 80 as described below, which ensures that the second tab F2*t* remains parallel to the flange 54 and parallel to the slots/grooves 54*g* to prevent binding when the adjustment ring 80 is used to change the operative position of the fingers F.

The adjustment ring 80 is defined from polymeric resin or metal and generally corresponds in size and shape to the flange 54 and is located adjacent an upper face of the flange 54 so as to overlie the flange 54. The flange 54 comprises at least two and preferably at least three mounting studs 55 that project outwardly therefrom, and the adjustment ring 80 comprises at least a corresponding number of elongated circumferentially extending mounting recesses or mounting slots 85 through which the mounting studs 55 respectively extend when the adjustment ring is positioned to lie adjacent the upper surface of the flange 54. The receipt of the mounting studs 55 through the mounting slots 85 serves to locate the adjustment ring 80 on the flange 54 and enables reciprocal circumferential movement of the adjustment ring 80 in a plane that lies parallel to the plane in which the mounting flange 54 lies. The extent of the elongated mounting slots 85 defines the limits of circumferential movement of the adjustment ring 80 relative to the flange 54 and mounting studs 55. After the adjustment ring is installed adjacent the flange 54, it is captured to the flange 54 so that it cannot move axially away from the flange. As shown herein, a keeper such as an enlarged head 86 is connected to each stud 55 by a screw or other fastener 57 engaged with the stud 55, and the adjustment ring 80 is axially captured between the enlarged head 86 and the flange 54, but with the adjustment ring still movable circumferentially relative to the flange 54. The enlarged head 86 can be provided as part of the fastener 57 or separate as shown.

The second tab F2*t* of each finger F or other part of the second end F2 of each finger F includes an adjustment stud FS that projects outwardly therefrom in direction extending transversely away from the collar flange 54, e.g., normal to the flange 54 as shown herein. The adjustment ring 80 includes at least a corresponding number of adjustment slots AS that respectively receive the finger adjustment studs FS and through which the finger adjustment studs FS extend. The adjustment slots are elongated and include a first or outer end AS1 located a first distance from the center of the cup storage space 14 (i.e., from the central longitudinal axis L) and include a second or inner end AS2 located a second distance from the center of the cup storage space 14 that is less than the first distance. As shown herein, the adjustment slots AS are identical to each other and each is arcuate or otherwise curved between the first and second ends AS1,AS2. The adjustment slots AS could be partly or completely linear between their first and second ends AS1,AS2. It is preferred that the adjustment slots AS be identical to each other to ensure that the fingers F will always be symmetrically located relative to the central axis L.

Figure 5:
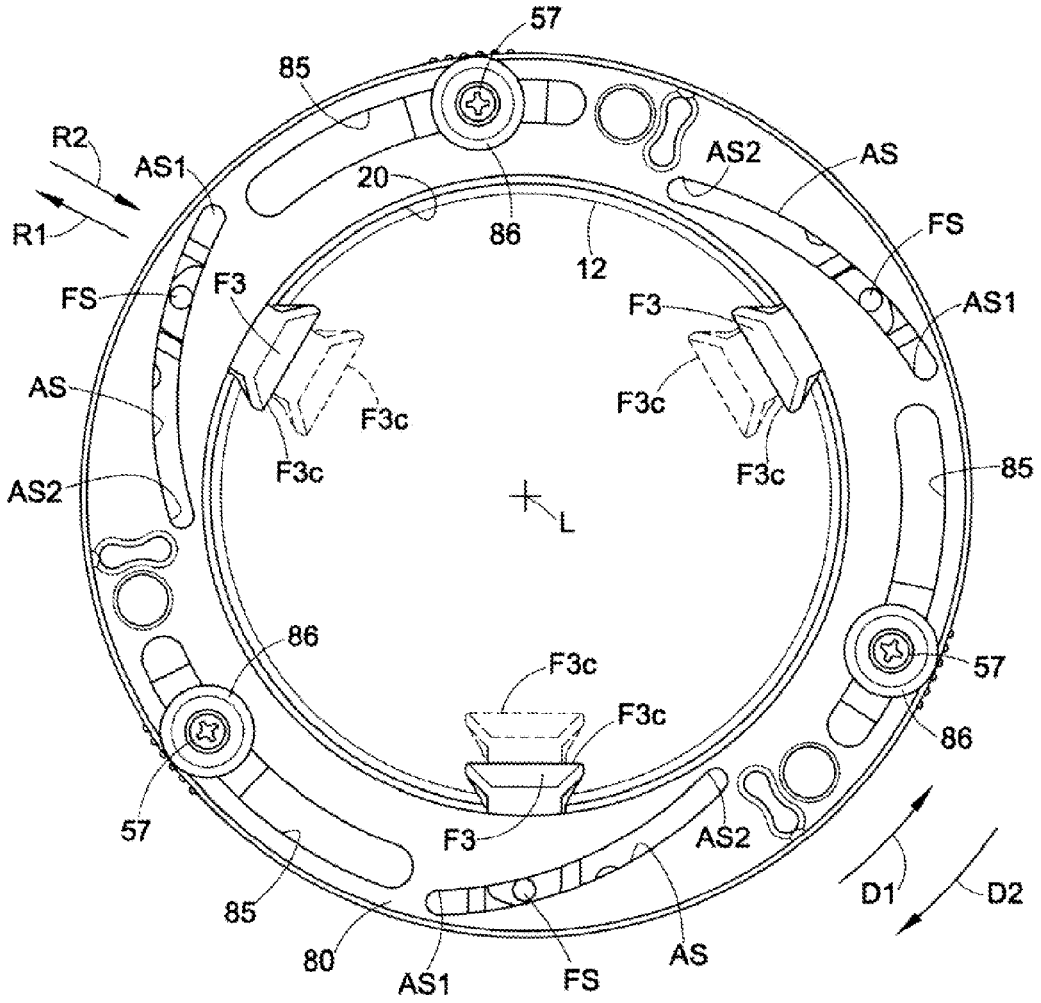
FIG. 5 is a top view with the pusher, spring, and decorative cover/clamp ring removed, and with an alternative position of the cup retaining fingers shown in broken lines.
Figure 5A:
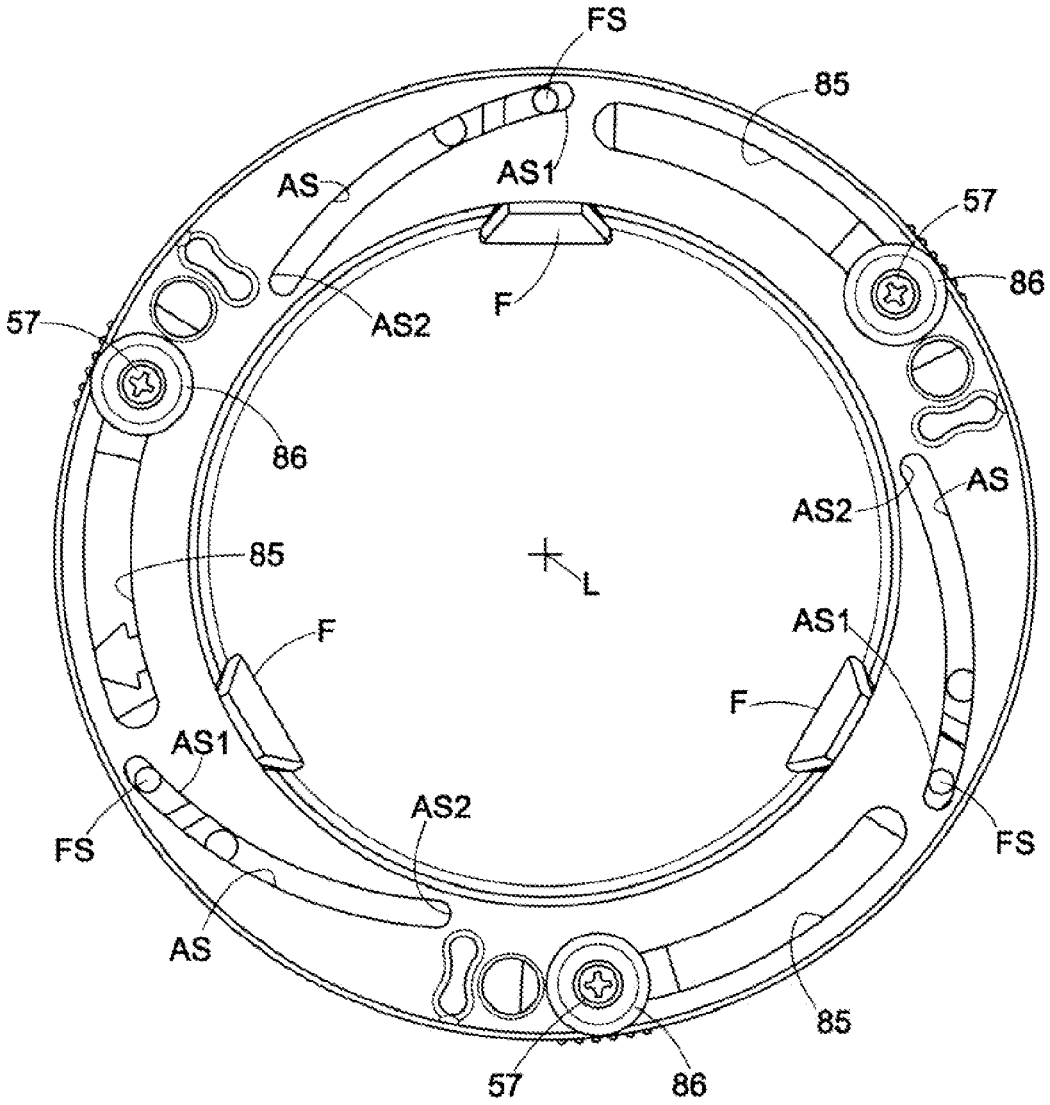
FIG. 5A is similar to FIG. 5 but shows the cup dispenser adjusted so that the cup retaining fingers are moved radially outward to the maximum possible extent.
Figure 5B:
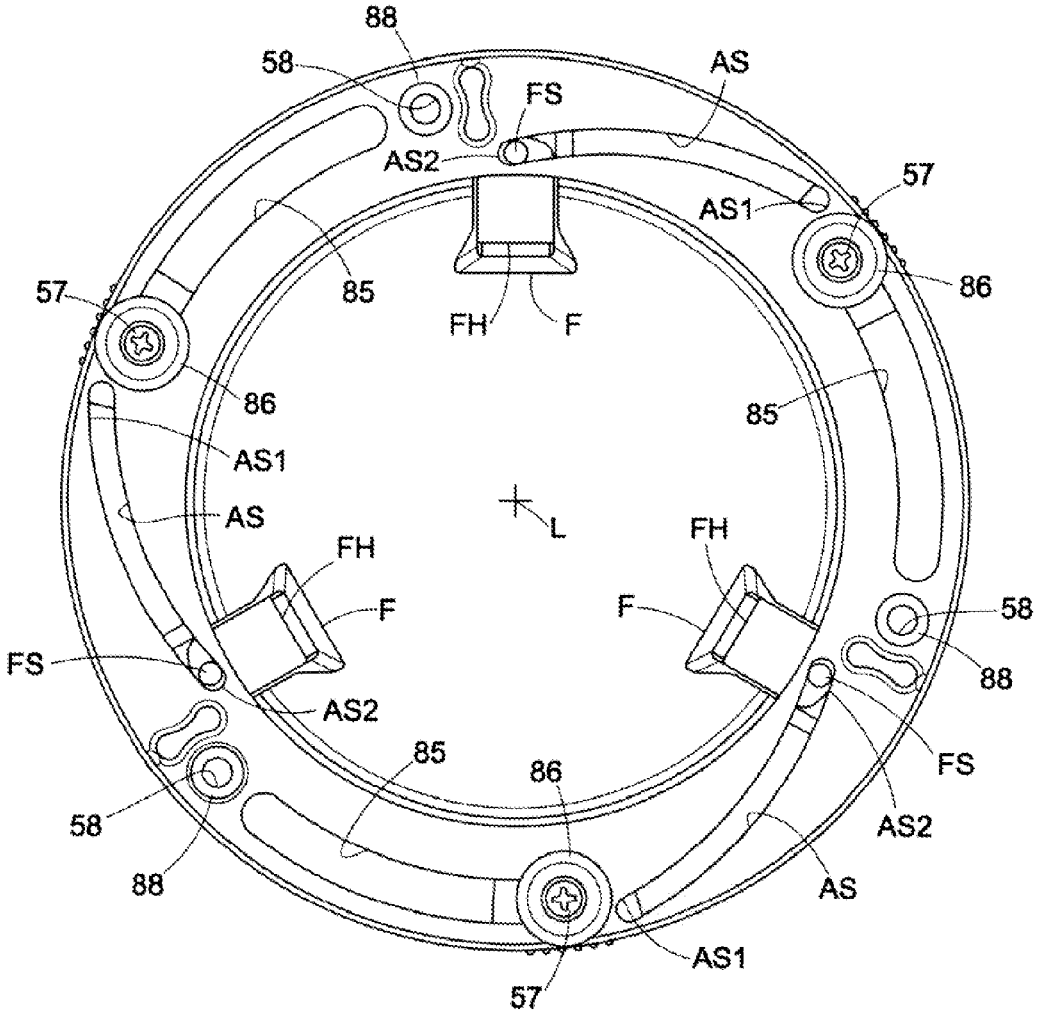
FIG. 5B is similar to FIG. 5A but shows the cup dispenser adjusted so that the cup retaining fingers are moved radially inward to the maximum possible extent.

Referring to FIG. 5, circumferential rotation of the adjustment ring 80 about the central axis L of the cup dispenser in a first direction as indicated by arrow D1 (FIG. 5) results in the adjustment slots AS moving relative to the respective finger adjustment studs FS such that the finger adjustment studs FS are located closer to or are positioned completely in the first (outer) ends AS1 of the respective adjustment slots AS. This change in relative position between each finger adjustment stud FS and its corresponding adjustment slot AS results in the finger adjustment studs FS (and the corresponding finger second ends F2 to which the finger adjustment studs FS are respectively connected) being moved radially outward in the direction R1 (shown in solid lines), which increases the distance of the finger tips F3*c* from the central axis L (and from each other) and increases the cup diameter that can be accommodated between and controlled by the tips F3*c* with the proper and desired cup retaining force. Conversely, circumferential rotation of the adjustment ring 80 about the central axis L in a second direction as indicated by arrow D2 results in the adjustment slots AS moving relative to the respective finger adjustment studs FS such that the finger adjustment studs FS are located closer to or are positioned completely in the second (inner) ends AS2 of the respective adjustment slots AS. This change in relative position between each finger adjustment stud FS and its corresponding adjustment slot AS results in the finger adjustment studs FS (and the corresponding finger second ends F2 to which the finger adjustment studs FS are respectively connected) being moved radially inward in the direction R2 (shown in broken lines), which decreases the distance of the finger tips F3*c* from the central axis L (and from each other) and decreases the cup diameter that can be accommodated between and controlled by the tips F3*c* with the proper and desired cup retaining force. FIG. 5A is similar to FIG. 5, and shows the cup dispenser A adjusted so that the cup retaining fingers F are moved radially outward to the maximum possible extent to retain large cups. Similarly, FIG. 5B shows the cup dispenser A adjusted so that the cup retaining fingers F are moved radially inward to the maximum possible extent to retain small diameter cups. As noted above, it is preferred that the length of the mounting slots 85 control the limits of circumferential movement of the adjustment ring 80. Alternatively, the adjustment slots AS are dimensioned to limit circumferential movement of the adjustment ring 80 when the respective adjustment studs FS reach the opposite ends AS1,AS2 thereof. As shown herein, the mounting slots 85 and the adjustment slots are dimensioned such that when the mounting studs 55 are located in one of the ends of the mounting slots 85, the adjustment studs FS are located in a corresponding one of the ends AS1,AS2 of the adjustment slots AS.

Each adjustment slot AS thus defines a cam and each finger adjustment stud FS located therein defines a follower. Accordingly, the adjustment ring 80 comprises a plurality of adjustment cams AS and each of said fingers F comprises a follower portion FS engaged with one of said adjustment cams AS such that movement of said adjustment ring 80 relative to the 10 body induces inward or outward radial movement of the fingers F relative to the body 10, depending upon the direction in which the adjustment ring 80 is rotated relative to the body. Upon rotation of the adjustment ring 80, the fingers F move simultaneously and uniformly, which eliminates the need for a user to adjust and gauge the radial position of each finger independently.

Figure 9:
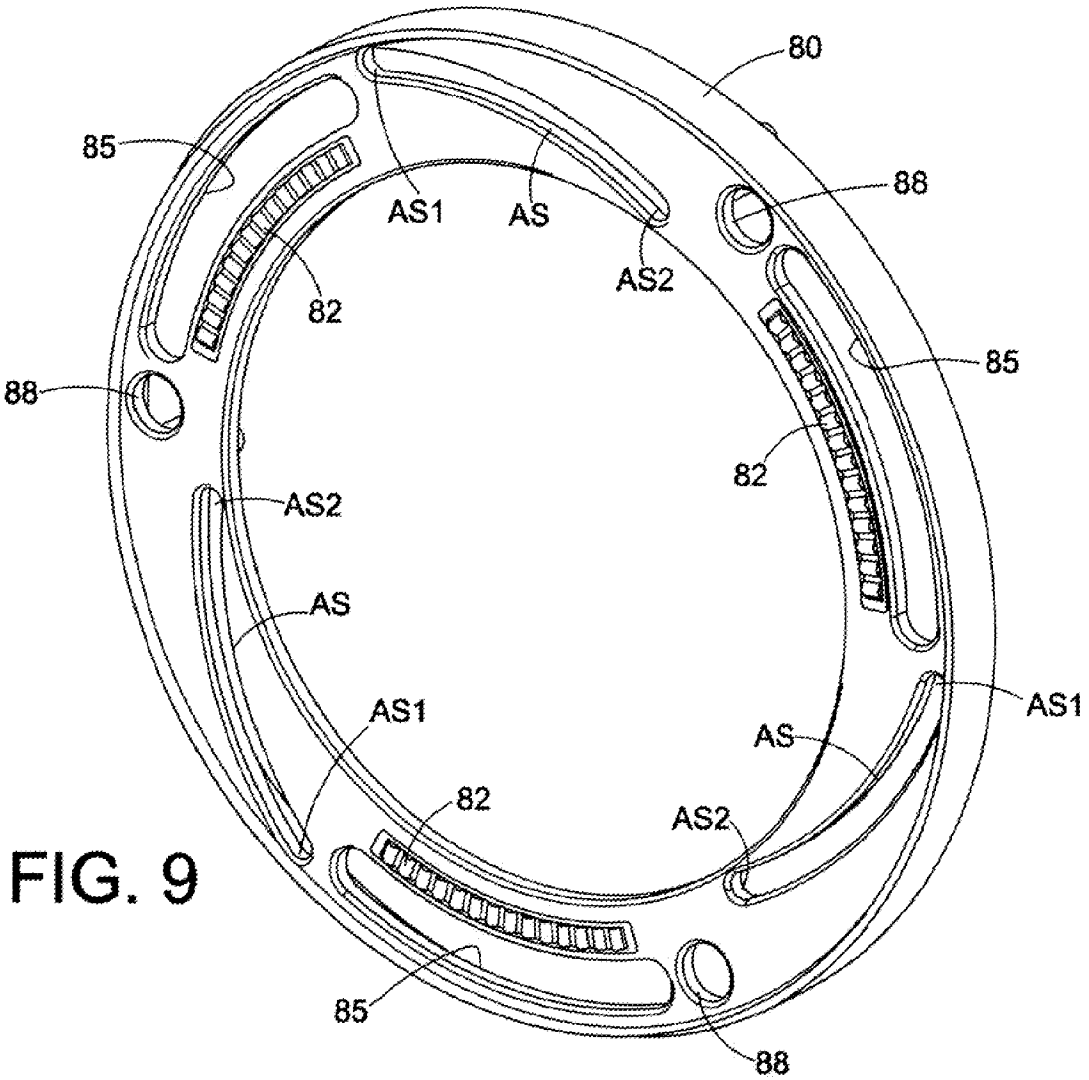
FIG. 9 is an isometric view that shows the adjustment ring by itself.

The adjustment ring 80 rotates about the central longitudinal axis L and can be restrained in its desired angular position by any suitable means such as frictional interference with the flange 54 or parts thereof. As shown in FIGS. 7 and 9, a lower surface 80*a* of the adjustment ring 80 is oriented toward the flange 54 and includes at least one saw-tooth region 82 defined by a plurality of teeth or serrations that are positioned to engage corresponding respective locking tabs or other locking projections 54*p* (FIG. 8) connected to the flange 54, such that rotational/angular movement of the adjustment ring 80 relative to the flange 54 must be made with sufficient manual force to overcome the engagement of the projection 54*p* with the saw-tooth region 82 in a ratchet-like manner. Alternatively, the saw-tooth region 82 is located on the flange 54 and the locking projection(s) 54*p* is(are) located on the adjustment ring 80. In another embodiment, a fastener, clip, spring and/or other means are used to selectively prevent movement of the adjustment ring 80 relative to the flange, e.g., by using the enlarged heads 86 to clamp the adjustment ring 80 in a desired position. The illustrated dispenser assembly A includes at least one adjustment ring spring or other biasing means for resiliently urging the adjustment ring 80 into engagement with the flange 54, to ensure that the saw-tooth regions 82 and projections 54*p* are firmly engaged with each other while still allowing the adjustment ring 80 to be manually rotated about the axis L as needed. In one embodiment, as shown herein, such adjustment ring springs are provided by resilient elastomeric spring washers 53 mounted on the studs 55 between the adjustment ring 80 and the enlarged heads 86. In one embodiment, the spring washers are provided by elastomeric O-rings or another annular elastomeric structure. Alternatively, a helical coil spring or other spring defined from metal or a polymer can be used and coaxially installed on each stud 55. These elastomeric spring washers 53 resiliently bias the adjustment ring 80 into abutment with the flange 54 such that the saw-tooth regions 82 are firmly engaged with the respective projections 54*p* to inhibit inadvertent rotation of the adjustment ring 80. The elastomeric spring washers 53 are sufficiently resilient to allow rotation of the adjustment ring 80 about the axis L with ratchet-like relative movement between the saw-tooth regions 82 and the projections 54*p*, without requiring the fasteners 57 to be loosened or removed. If needed, a low-friction metal or polymeric washer bearing 53*b* is included between the elastomeric spring washer 53 and the adjustment ring 80 to ensure that friction between the adjustment ring 80 and the elastomeric spring washers 53 is not great enough to prevent purposeful rotation of the adjustment ring 80. The washer bearing 53*b* preferably includes a tubular stepped shoulder portion 53*b*1 that is coaxially positioned on the stud 55 and a flange portion 53*b*2 that projects radially from the tubular portion 53*b*1, and the spring washer 53 is coaxially positioned around the tubular portion 53*b*1. The tubular portion 53*b*1 inhibits excessive movement or compression of the surrounding spring washer 53 due to contact between the tubular portion 53*b*1 and the associated enlarged head 86.

As noted above, the adjustment ring 80 includes access openings 88 that can be selectively registered with the mounting apertures 58 of the flange 54 to allow installation of the fasteners required to secure the flange 54 to an associated cabinet or other mounting structure B.

The dispenser A further comprises a decorative clamp ring or cover ring 90 that is selectively secured in covering relation over the adjustment ring 80 to conceal and protect same and to discourage tampering with same. Typically the cover ring 90 is defined from a polymeric resin material, but it could be metal. The cover ring 90 includes internal notches or undercuts 92 dimensioned and positioned to engage the respective enlarged heads 86 with a snap-fit or friction-fit when the clamp-ring 90 is operatively connected to the mounting collar 50 as shown in the enlarged "Detail 3A" portion of FIG. 3. Suitable external markings or indicia 93 such as labels, ribs, indentations, colored markings and/or the like are provided on the cover ring 90 to assist a user in aligning the undercuts 92 with the enlarged heads 86 when installing the ring 90. In one embodiment, the cover ring 90 is used to lock the adjustment ring 80 in position once the adjustment ring has been moved to its desired position.

The dispenser assembly A operates as will be understood by those of ordinary skill in the art. A telescopically interfitted or nested stack of cups is inserted into the cup storage space 14 via body open end 20 with resulting resilient deflection of the fingers F (optionally the adjustment ring 80 can be positioned to spread the fingers F to facilitate insertion of the stack of cups). The cup stack is pushed into the cup storage space 14 with sufficient force to overcome the biasing force of the spring 60 so that the cup pushing member 62 moves inwardly toward the closed second end 22 of the body 10. If required, before or after insertion of the cup stack, the cover ring 90 is removed and the position of the adjustment ring 80 is rotatably adjusted to set the desired position of the fingers F based upon the size and/or type of cups to be dispensed, and the cover ring 90 is then replaced. After the cup stack is loaded into the cup receiving region 14, the cup pushing member 62, in response to the biasing force of the spring 60, urges the cup stack outwardly toward the open first end 20 of the body 10 so that the closed end or bottom of the outermost cup in the stack projects out through the open first end 20 between the fingers F. To dispense a single cup, a user manually pulls the outermost exposed cup so that the fingers deflect resiliently outward sufficiently to allow only the outermost cup to be released. The finger tips F3*c* engage the next outermost cup in the stack and prevents it from exiting the cup storage space 14.

The development has been described with reference to preferred embodiments. It is not intended that the scope of the claims be limited to the preferred embodiments. Instead, it is intended that the claims be construed literally and/or according to the doctrine of equivalents as broadly as legally possible.

The invention claimed is:

1. A cup dispenser comprising:

a body defining a storage region adapted for receiving for an associated stack of cup-shaped articles, said body including an open end that provides access to the storage region;

a plurality of fingers connected to the body for restricting said open end of the body, each of said fingers comprising a first end connected to said body, a second end spaced from said first end, and an adjustment stud follower projecting from said second end, wherein each of said fingers comprises a ramped portion located between the first and second ends, said ramped portion comprising a first ramp surface that converges toward a center of the cup storage region as it extends away from said open end of said body toward an opposite end of said body and a second ramp surface located between the first ramp surface and the first end, wherein said second ramp surface diverges away from said center of said cup storage region as it extends away from said open end of said body toward the opposite end of said body;

an adjustment ring connected to the body and movable relative to the body, said adjustment ring comprising a plurality of adjustment slots, wherein the adjustment stud of each finger is located in a respective one of said adjustment slots such that circumferential movement of said adjustment ring relative to said body alters a position of each of said fingers relative to said body, wherein each of said fingers moves radially outward and inward in response to circumferential movement of said adjustment ring in first and second directions, respectively.

2. The cup dispenser as set forth in claim 1, wherein movement of said adjustment ring relative to said body simultaneously and uniformly adjusts said position of each of said fingers relative to said body.

3. The cup dispenser as set forth in claim 2, wherein said fingers are circumferentially spaced-apart from each other and symmetrically arranged about a central longitudinal axis of said storage region.

4. The cup dispenser as set forth in claim 1, wherein movement of said adjustment ring in a first direction relative to said body causes radial outward movement of each of said fingers, and movement of said adjustment ring in a second direction relative to said body causes radial inward movement of each of said fingers.

5. The cup dispenser as set forth in claim 1, wherein each of said fingers defines a tip that interconnects said first ramp surface to said second ramp surface.

6. The cup dispenser as set forth in claim 5, wherein each of said fingers further comprises:

a tab connected to said first ramp surface by a living hinge, wherein said adjustment stud of each is connected to said tab.

7. The cup dispenser as set forth in claim 1, further comprising:

a mounting collar connected to said body, said mounting collar including a flange projecting outwardly there from;

said adjustment ring located adjacent the flange of said mounting collar and movable relative to said flange circumferentially about a longitudinal axis of said storage region.

8. The cup dispenser as set forth in claim 7, wherein:

each of said adjustment slots comprises an outer end located a first distance from said longitudinal axis and an inner end located a second distance from said longitudinal axis, and said second distance is less than said first distance.

9. A cup dispenser comprising:

a body defining a storage region adapted for receiving for an associated stack of cup-shaped articles, said body including an open end that provides access to the storage region;

a mounting collar connected to said body, said mounting collar including a flange projecting outwardly there from;

an adjustment ring located adjacent the flange of said mounting collar and movable relative to said flange circumferentially about a longitudinal axis of said storage region, said adjustment ring comprising a plurality of adjustment slots, each of said adjustment slots comprising an outer end located a first distance from said longitudinal axis and an inner end located a second distance from said longitudinal axis, and said second distance is less than said first distance;

a plurality of fingers connected to the body for restricting said open end of the body, each of said fingers comprising a first end connected to said body, a second end spaced from said first end, and an adjustment stud follower projecting from said second end;

wherein the adjustment stud of each finger is located in a respective one of said adjustment slots of said adjustment ring such that circumferential movement of said adjustment ring relative to said body alters a position of each of said fingers relative to said body, wherein each of said fingers moves radially outward and inward in response to circumferential movement of said adjustment ring in first and second directions, respectively;

wherein each of said fingers comprises:

a ramped portion located between the first and second ends; and, a tab connected to said ramped portion wherein said tab of each finger is located between said adjustment ring and said flange, and said adjustment stud follower of each finger is connected to the tab.

10. The cup dispenser as set forth in claim 9, wherein said flange comprises a plurality of radially extending grooves, and wherein said tab of each finger is slidably received in a respective one of said radially extending grooves.

11. A cup dispenser comprising:

a body defining a storage region adapted for receiving for an associated stack of cup-shaped articles, said body including an open end that provides access to the storage region;

a mounting collar connected to said body, said mounting collar including a flange projecting outwardly there from;

said adjustment ring located adjacent the flange of said mounting collar and movable relative to said flange circumferentially about a longitudinal axis of said storage region;

a plurality of fingers connected to the body for restricting said open end of the body, each of said fingers comprising a first end connected to said body, a second end spaced from said first end, and an adjustment stud follower projecting from said second end;

an adjustment ring connected to the body and movable relative to the body, said adjustment ring comprising a plurality of adjustment slots, wherein the adjustment stud of each finger is located in a respective one of said adjustment slots such that circumferential movement of said adjustment ring relative to said body alters a position of each of said fingers relative to said body, wherein each of said fingers moves radially outward and inward in response to circumferential movement of said adjustment ring in first and second directions, respectively;

wherein said flange comprises a plurality of mounting studs and said adjustment ring comprises a plurality of elongated mounting slots in which said mounting studs are respectively located, said cup dispenser further comprising a plurality of enlarged heads respectively connected to said plurality of mounting studs that capture said adjustment ring adjacent said flange.

12. The cup dispenser as set forth in claim 11, further comprising at least one biasing spring for urging said adjustment ring axially toward said flange.

13. The cup dispenser as set forth in claim 12, further comprising a saw tooth region connected to one of said flange and adjustment ring and a locking projection connected to the other of the flange and adjustment ring, wherein said saw tooth region and said locking projection are engaged to restrain said adjustment ring in a select position relative to said flange and said locking projection and said saw tooth region are selectively slidable in a ratchet-like manner relative to each other.

14. A cup dispenser comprising:

a body defining a storage region adapted for receiving for an associated stack of cup-shaped articles, said body including an open end that provides access to the storage region;

a plurality of fingers connected to the body for restricting said open end of the body, each of said fingers comprising: a first end connected to the body; a second end; and, a ramped portion located between the first and second ends, each of said fingers further comprising a tab including a projecting adjustment stud;

an adjustment ring connected to the body and movable relative to the body, said adjustment ring comprising a plurality of adjustment slots, wherein said adjustment stud of each finger is engaged with a respective one of said adjustment slots such that movement of said adjustment ring relative to said body alters a position of each of said fingers relative to said body, and wherein each of said fingers moves radially inward and outward in response to circumferential movement of said adjustment ring.

15. The cup dispenser as set forth in claim 14, wherein said movement of said adjustment ring relative to said body simultaneously and uniformly adjusts said position of each of said fingers relative to said body.

16. The cup dispenser as set forth in claim 14, wherein said fingers are circumferentially spaced-apart from each other and symmetrically arranged about a central longitudinal axis of said storage region.

17. The cup dispenser as set forth in claim 14, wherein movement of said adjustment ring in a first direction relative to said body causes radial outward movement of each of said fingers, and movement of said adjustment ring in a second direction relative to said body causes radial inward movement of each of said fingers.

* * * * *